US006019233A

United States Patent [19]

Yu

[11] Patent Number: 6,019,233

[45] Date of Patent: Feb. 1, 2000

[54] SHOWER CURTAIN SUSPENSION DEVICE

[76] Inventor: San-Chih Yu, No. 73-17, Sec. 2, Chunghsing Rd., Tali City, Taichung Hsien, Taiwan

[21] Appl. No.: 09/107,606

[22] Filed: Jun. 30, 1998

[51] Int. Cl.[7] ..... A47F 5/08

[52] U.S. Cl. ..... 211/87.01

[58] Field of Search ..... 211/87.01, 106, 211/119.01, 119.1, 119.15

[56] References Cited

U.S. PATENT DOCUMENTS

| | | | |
|---|---|---|---|
| 534,116 | 2/1895 | Lyons | 211/87.01 |
| 1,058,595 | 4/1913 | Kavanagh | 211/87.01 |

*Primary Examiner*—Alvin Chin-Shue
*Assistant Examiner*—Sarah Purol
*Attorney, Agent, or Firm*—Welsh & Katz, Ltd.

[57] ABSTRACT

A suspension device includes a washer fixedly mounted and containing a center hole, a supporting column having one end portion formed with a stub fitted in the center hole, a suspension base having a first end portion fixedly mounted on the supporting column and a second end portion transversely containing a through hole, a connecting shaft extending through the through hole and having a first end portion and a second end portion longitudinally containing a passage and transversely containing at least one threaded bore open to the passage, a positioning base fixedly mounted on the first end portion of the connecting shaft and abutting the second end portion of the suspension base, a wire rope including one end portion extending through the passage, and at least one positioning screw threaded in the threaded bore and pressing the one end portion of the wire rope.

9 Claims, 6 Drawing Sheets

SHOWER CURTAIN SUSPENSION DEVICE

FIELD OF THE INVENTION

The present invention relates to a suspension device, and more particularly to a suspension device for suspending a shower curtain.

BACKGROUND OF THE INVENTION

A conventional shower curtain suspension device is shown in FIG. 6, and there will be a complete illustration in the detailed description of the preferred embodiments, concerning the conventional shower curtain suspension device. The present invention has arisen to mitigate and/or obviate the disadvantage of the conventional shower curtain suspension device.

SUMMARY OF THE INVENTION

In accordance with one aspect of the present invention, there is provided a suspension device comprising a washer fixedly mounted and containing a center hole, a supporting column including one end portion formed with a stub securely fitted in the center hole, a suspension base including a first end portion fixedly mounted on the supporting column and a second end portion transversely containing a through hole, a connecting shaft extending through the through hole of the suspension base and including a first end portion and a second end portion longitudinally containing a passage and transversely containing at least one threaded bore open to the passage, a positioning base fixedly mounted on the first end portion of the connecting shaft and abutting the second end portion of the suspension base, a wire rope including one end portion extending through the passage, and at least one positioning screw threaded in the threaded bore and pressing the one end portion of the wire rope.

Further benefits and advantages of the present invention will become apparent after a careful reading of the detailed description with appropriate reference to the accompanying drawings.

DETAILED DESCRIPTION OF THE PREFERRED EMBODIMENTS

Figure 6:
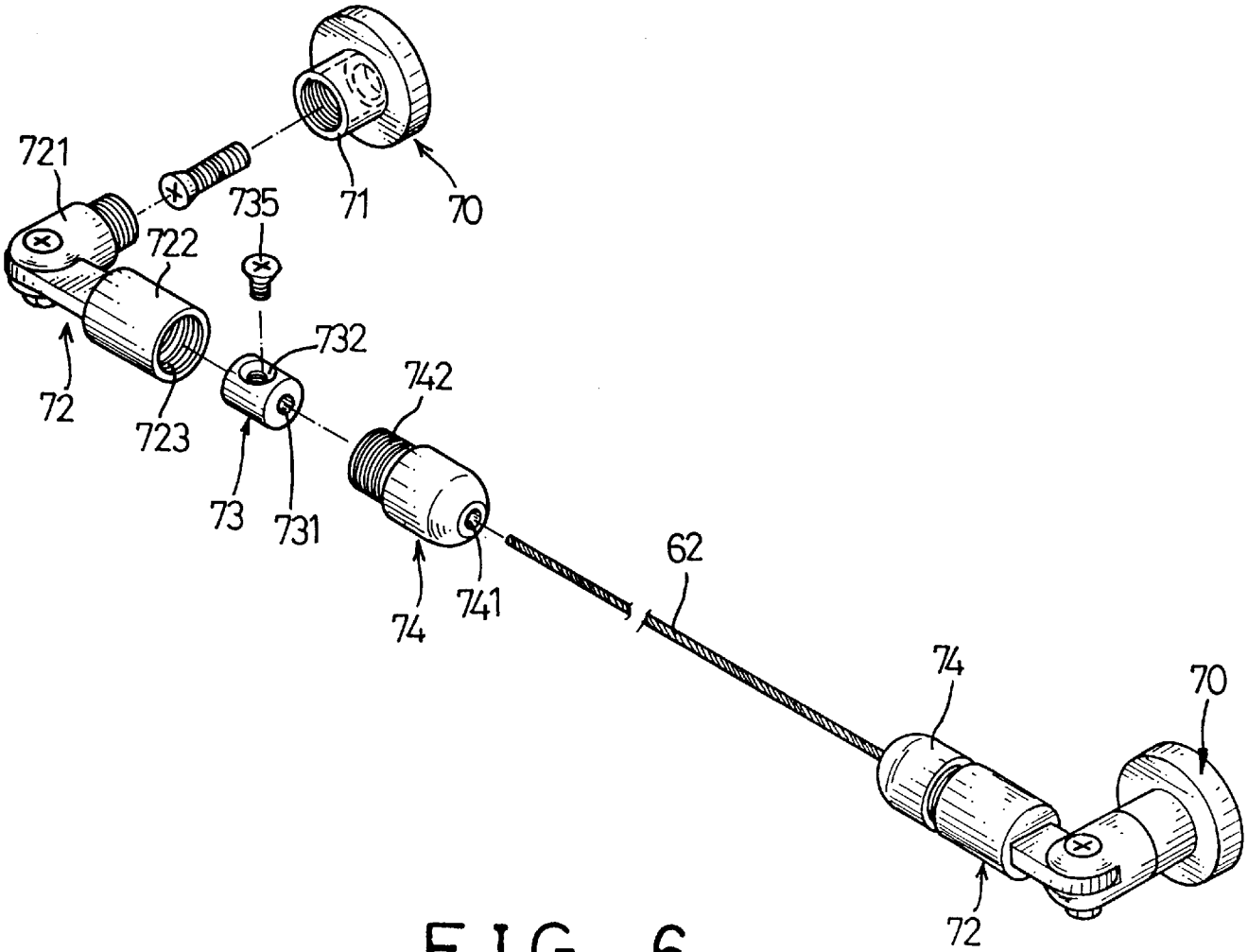
FIG. 6 PRIOR ART
FIG. 6 is an exploded view of a shower curtain suspension device in accordance with the prior art.

For a better understanding of the present invention, reference is made to FIG. 6 illustrating a conventional suspension device in accordance with the prior art.

The conventional suspension device can be used in a bathroom (not shown) for suspending a shower shower curtain (not shown) on a wire rope 62 and comprises two positioning bases 70 each fixedly mounted on a supporting jamb (not shown) in the bathroom and each formed with a sleeve 71, a connecting joint 72 including a column 721 threaded into the sleeve 71 and a sleeve 722 pivotally connected with the column 721 and containing an threaded hole 723, a positioning post 73 received in a threaded hole 723 in the sleeve 722 which contains a through hole 731 and a threaded bore 732 open to the through hole 731, and a coupling 74 formed with an outer thread 742 threaded into the threaded hole 723 to abut the positioning post 73 and containing a passage 741 connecting to the through hole 731. Each of the two end portions of the wire rope 62 can extend through the passage 741 and the through hole 731, and a positioning screw 735 each can be threaded into the threaded bore 732 to press the end portion of the wire rope 62, thereby securing the wire rope 62 into the connecting joint 72.

By such an arrangement, however, each of the two end portions of the wire rope 62 is secured in the positioning post 73 by means of the positioning screw 735 only such that the end portion of the wire rope 62 is easily detached from the positioning post 73 during long-term utilization. In addition, the sleeve 722 can be pivoted to the column 721 to displace the wire rope 62, thereby easily causing inconvenience when the intent is to slide the shower shower curtain along the wire rope 62.

Referring now to FIGS. 1–4, two suspension devices in accordance with the present invention can be used in a bathroom for tensioning and stretching a steel wire 60 between two supporting jambs 82 so as to suspend a shower shower curtain 80.

Each of the suspension devices comprises a washer 11 mounted on one of the supporting jambs 82 and containing a center hole 111. A supporting column 20 includes one end portion formed with a stub 21 securely fitted in the center hole 111 and longitudinally contains a guiding channel 22 therein. A suspension base 40 includes a first end portion fixedly mounted on the supporting column 20 and a second end portion transversely containing a through hole 42. The supporting column 20 includes an outer periphery formed with an outer thread 23, and the suspension base 40 contains a threaded hole 41 in the first end portion in which the supporting column 20 is screwed.

A connecting shaft 50 extends through the through hole 42 and includes a first end portion formed with an outer thread 51 and a second end portion 53 longitudinally containing a passage 530 and transversely containing two threaded bores 531 each open to the passage 530. The second end portion 53 of the connecting shaft 50 abuts the second end portion of the suspension base 40 and has a diameter greater than that of the through hole 42. The connecting shaft 50 further transversely contains an opening 532 in the second end portion 53 thereof.

A hexagonal positioning base 55 is screwed onto the first end portion of the connecting shaft 50 by a longitudinal threaded hole 551. The hexagonal positioning base 55 abuts the second end portion of the suspension base 40 and has a dimension greater than the diameter of the through hole 42.

The wire rope 60 includes two end portions each extending through the passage 530 of the corresponding second end portion 53 of the connecting shaft 50. Two positioning screws 534 are each screwed into one of the two threaded bores 531 and each securely presses each of the two end portions of the wire rope 60, thereby securing each of the two end portions of the wire rope 60 to the connecting shaft 50.

A positioning ring 57 abutting the second end portion 53 of the connecting shaft 50 is mounted on each of the two end portions of the steel wire 60 and transversely contains a second threaded bore 572, and a second positioning screw 574 is threaded into the second threaded bore 572 and presses each of the two corresponding end portions of the wire rope 60.

Figure 1:
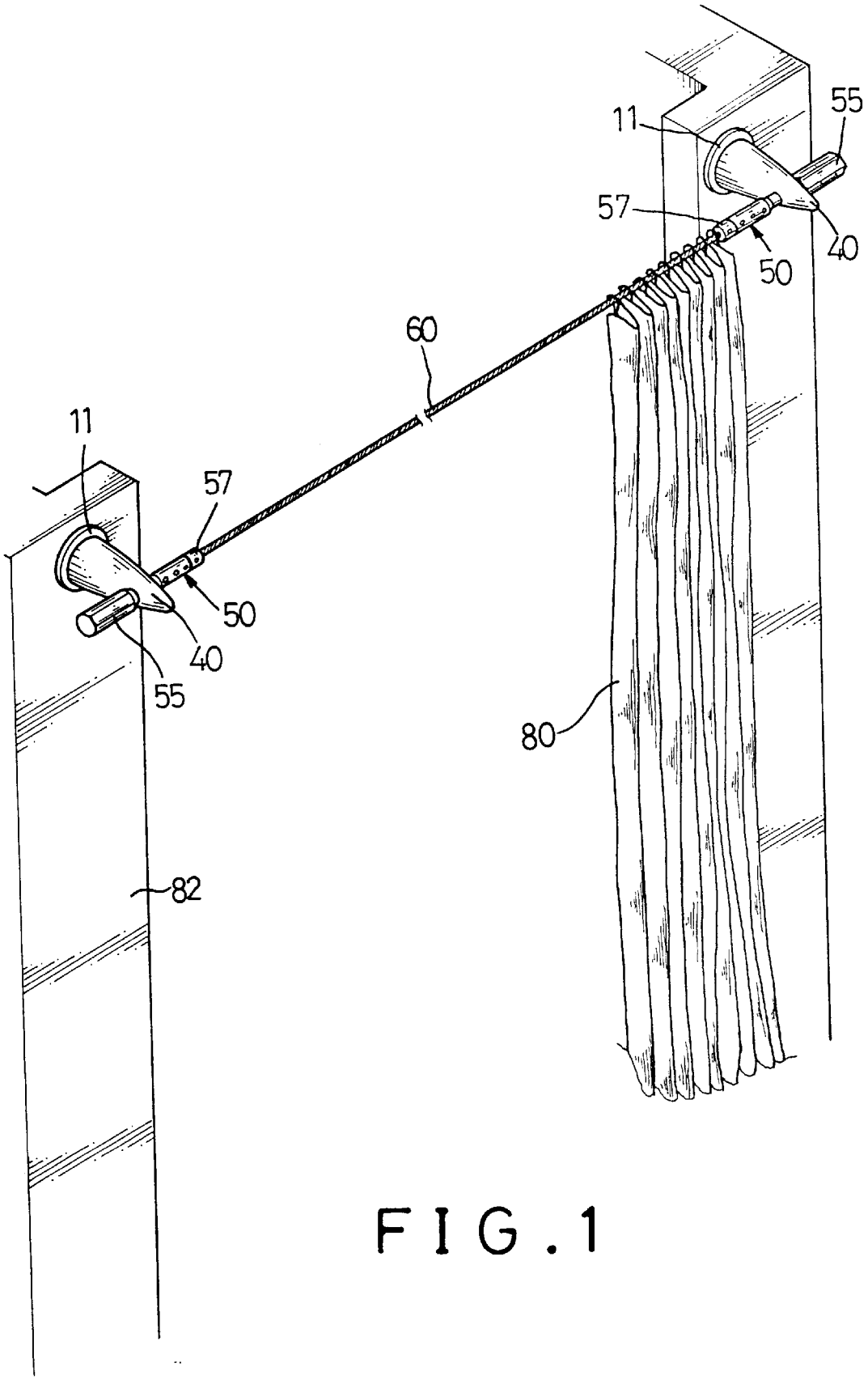
FIG. 1 is a schematic view of a shower curtain suspension device in accordance with the present invention.
Figure 2:
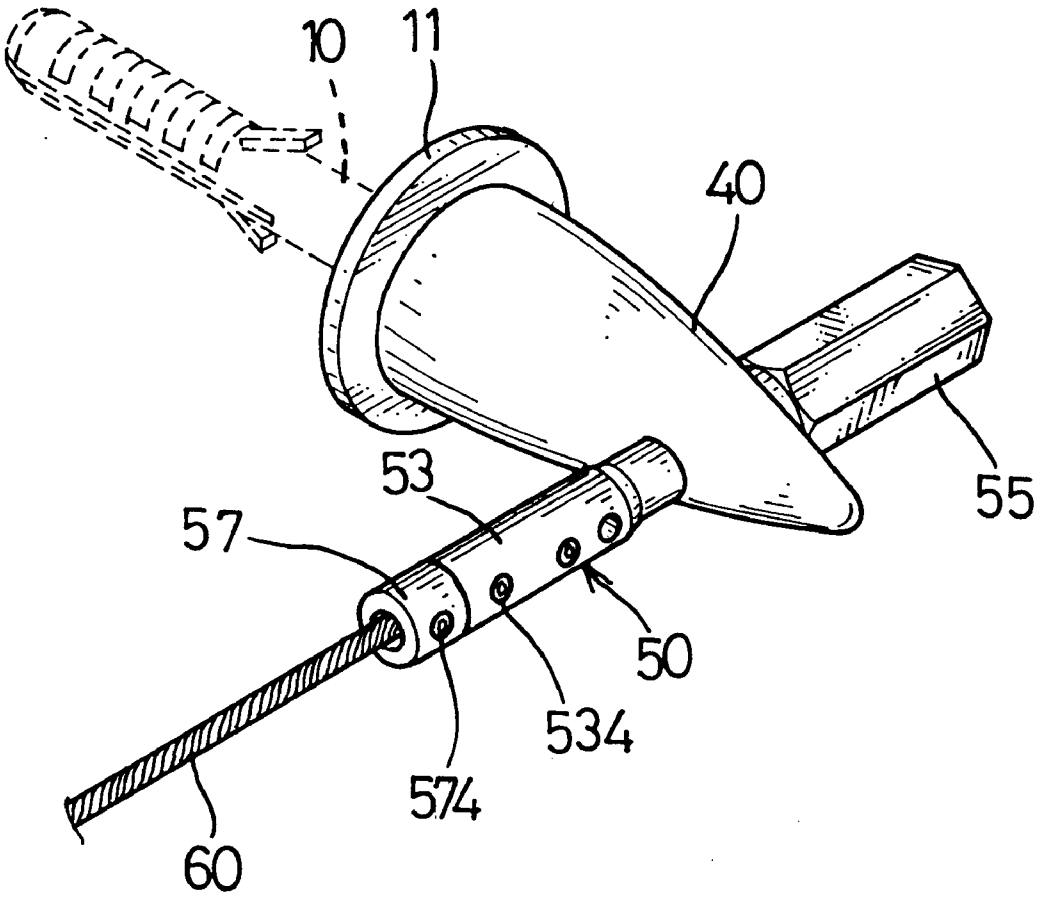
FIG. 2 is a perspective view of the shower curtain suspension device as shown in FIG. 1 on a large scale.
Figure 3:
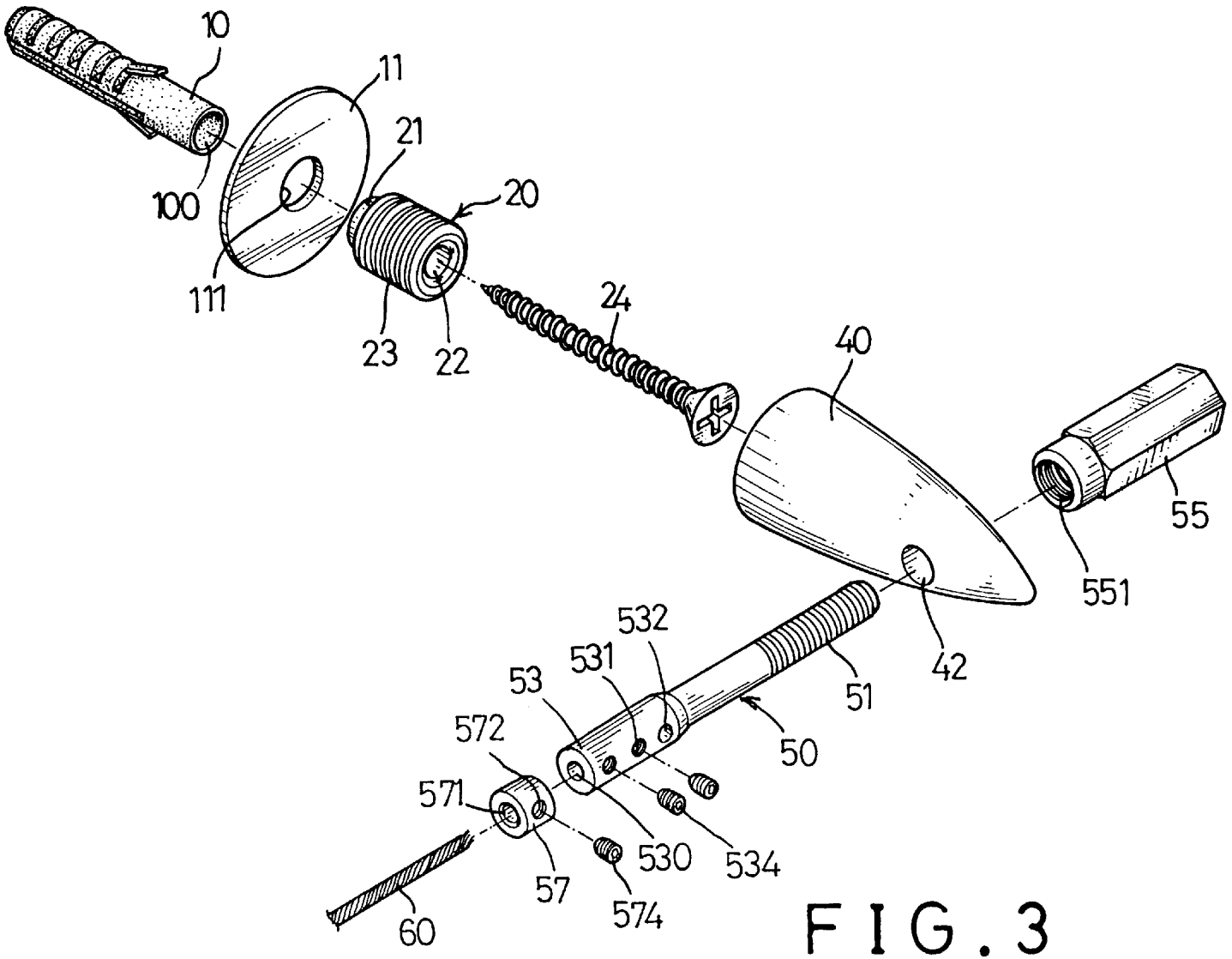
FIG. 3 is an exploded view of the shower curtain suspension device as shown in FIG. 2.
Figure 4:
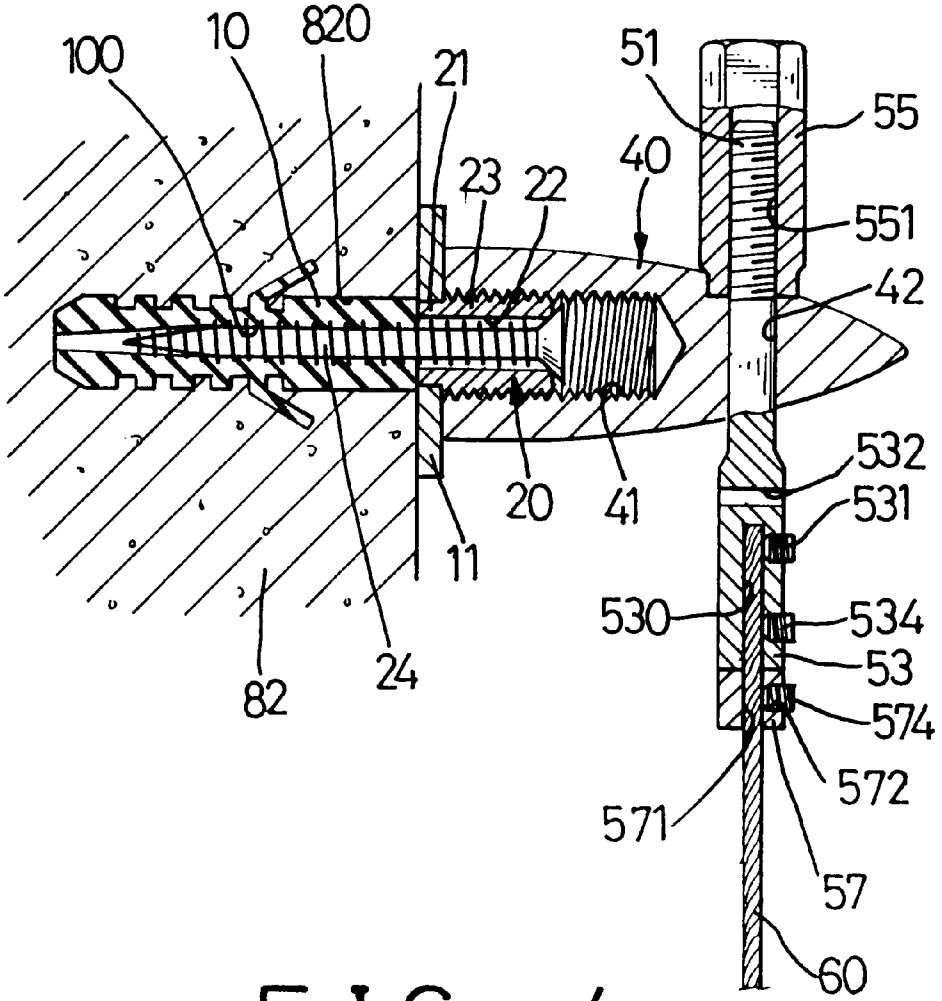
FIG. 4 is a top plan cross-sectional view of the shower curtain suspension device as shown in FIG. 2.

In operation, referring to FIGS. 3 and 4 with reference to FIGS. 1 and 2, a wall anchor 10 can be pre-fitted into a cavity 820 transversely contained in each of the two supporting jambs 82. The washer 11 together with the supporting column 20 can then abut the supporting jamb 82 with the guiding channel 22 connecting to the hole 100 longitudinally contained in the wall anchor 10. A retaining screw 24 can then be threaded into the hole 100 via the guiding channel 22, thereby expanding the wall anchor 10 radially outward such that the wall anchor 10 together with the supporting column 20 can be secured to the supporting jamb 82. Then, the suspension base 40 can be screwed onto the supporting column 20 as shown in FIG. 2.

Each of the two end portions of the wire rope 60 can then be inserted into the hole 571 contained in the positioning ring 57 and the passage 530 of the second end portion 53 of the connecting shaft 50, and the first positioning screws 534 and the second positioning screw 574 can be respectively threaded into the first threaded bores 531 and the second threaded bore 572 to press the end portion of the wire rope 60, thereby securely attaching each of the two end portions of the wire rope 60 to the connecting shaft 50 which can then extend through the through hole 42 of the suspension base 40. Then, the hexagonal positioning base 55 can be screwed onto the outer thread 51 of the connecting shaft 50 by means of a tool such as a ratchet wrench (not shown) so as to position the connecting shaft 50, thereby stretching the wire rope 60 for suspending the shower shower curtain 80 as shown in FIG. 1.

The tension strength exerted on the wire rope 60 can be adjusted by means of the rotation of the positioning base 55 relative to the connecting shaft 50. In addition, when a ratchet wrench cannot be used to rotate the positioning base 55 due to limited space, a tool such as a bar or a rod (not shown) can be inserted into the opening 532 so as to rotate the connecting shaft 50 relative to the positioning base 55, thereby adjusting the tension exerted on the wire rope 60.

Figure 5:
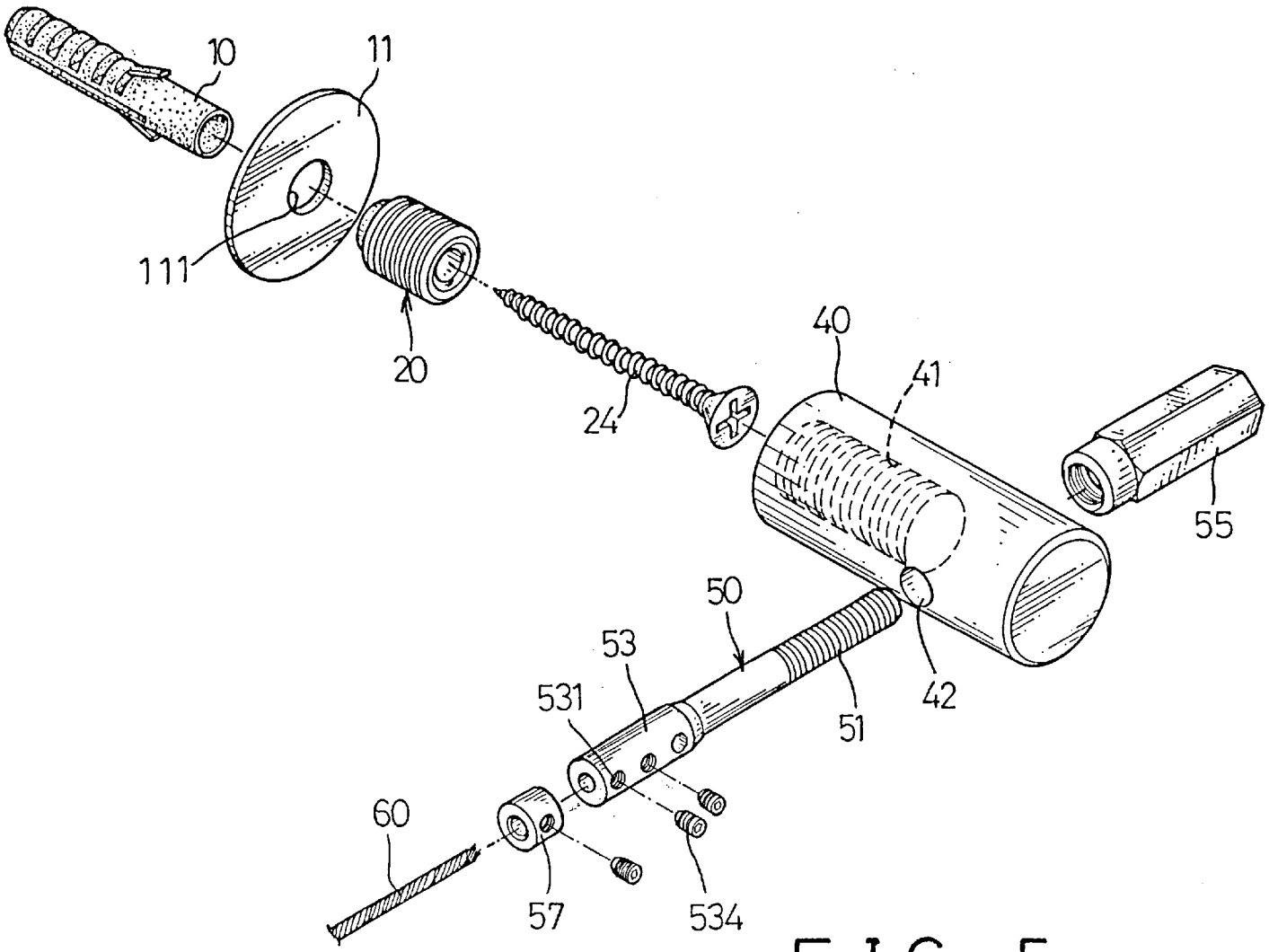
FIG. 5 is an exploded view of a shower curtain suspension device in accordance with another embodiment of the present invention.

Referring now to FIG. 5, in accordance with another embodiment of the present invention, the suspension base 40 has a cylindrical shape.

It should be clear to those skilled in the art that further embodiments may be made without departing from the scope and spirit of the present invention.

What is claimed is:

1. A suspension device comprising:

a washer fixedly mounted and containing a center hole;

a supporting column including one end portion formed with a stub securely fitted in said center hole;

a suspension base including a first end portion fixedly mounted on said supporting column and a second end portion transversely containing a through hole;

a connecting shaft extending through said through hole and including a first end portion and a second end portion longitudinally containing a passage and transversely containing at least one threaded bore open to said passage;

a positioning base fixedly mounted on said first end portion of said connecting shaft and abutting said second end portion of said suspension base;

a wire rope including one end portion extending through said passage; and at least one positioning screw threaded in said threaded bore and pressing sad one end portion of sad wire rope.

2. The suspension device in accordance with claim 1, wherein said supporting column includes an outer periphery formed with an outer thread, and said suspension base containing a threaded hole in the first end portion thereof threadedly receiving said outer thread of said supporting column.

3. The suspension device in accordance with claim 1, wherein said suspension base has a cylindrical shape.

4. The suspension device in accordance with claim 1, wherein said second end porion of said connecting shaft abuts said second end porion of sad suspension base and has a diameter greater than that of said through hole.

5. The suspension device in accordance with claim 1, wherein said connecting shaft includes an outer thread formed on the first end porion thereof, and said positioning base contains a threaded hole threadedly receiving said outer thread.

6. The suspension device in accordance with claim 1, wherein said positioning base has a hexagonal shape.

7. The suspension device in accordance with claim 1, wherein said positioning base has a dimension grater than the diameter of said through hole.

8. The suspension device in accordance with claim 1, further comprising a positioning ring mounted on said one end portion of said wire rope and abutting said second end portion if said connecting shaft, a second threaded bore transversely contained in said positioning ring, and a second positioning screw threaded in said second threaded bore and pressing said one end portion of sad wire rope.

9. The suspension device in accordance with claim 1, wherein said connecting shaft transversely contains an opening in said second end portion thereof.

* * * * *